US006076576A

United States Patent [19]

Maddox et al.

[11] Patent Number: 6,076,576

[45] Date of Patent: Jun. 20, 2000

[54] LOG SPLITTER

[76] Inventors: James B. Maddox, 562 McMillan Rd., Ochlocknee, Ga. 31772; Robert A. Kelzer, 2283 E. Pinetree Blvd., Thomasville, Ga. 31792

[21] Appl. No.: 09/200,575

[22] Filed: Nov. 27, 1998

Related U.S. Application Data

[60] Provisional application No. 60/067,312, Nov. 28, 1997.

[51] Int. Cl.[7] ..... B27L 7/00

[52] U.S. Cl. ..... 144/195.1; 144/193.1; 144/366

[58] Field of Search ..... 144/193.1, 195.8, 144/195.1, 366

[56] References Cited

U.S. PATENT DOCUMENTS

| | | | |
|---|---|---|---|
| 4,192,364 | 3/1980 | Findley | 144/195.1 |
| 4,239,070 | 12/1980 | Burns | 144/195.1 |
| 4,310,039 | 1/1982 | O'Brien | 144/195.1 |
| 4,351,377 | 9/1982 | Hamel . | |
| 4,679,607 | 7/1987 | Bradley | 144/195.1 |
| 4,782,870 | 11/1988 | Duerr . | |
| 5,284,193 | 2/1994 | Mires . | |
| 5,337,810 | 8/1994 | McCormack . | |
| 5,373,877 | 12/1994 | Chapman . | |

*Primary Examiner*—W. Donald Bray
*Attorney, Agent, or Firm*—Brian D. Bellamy

[57] ABSTRACT

A wood splitter having an elongated beam including a center rail, a horizontally disposed top surface and a horizontally disposed bottom surface defining a pair of channels. A first push member is attached at an end of the beam. An elongated frame is position above the bottom surface of the beam and is movable along the longitudinal axis of the beam. Hydraulic cylinders within each of the channels operate to push a second push member attached at an end of the frame away from the first push member to cause a splitting wedge to engage a log supported by the top surface.

8 Claims, 7 Drawing Sheets

LOG SPLITTER

This application claims benifit of Provisional Application Ser. No. 60/067,312, filed Nov. 28, 1997.

INTRODUCTION

1. Field of the Invention

The present application relates to an apparatus for splitting logs and wood, and in particular, to a hydraulically powered compact log splitter.

2. Description of the Related Art

Numerous wood splitting devices using a wedge to divide a wood log into smaller pieces are known. It is common for these known devices to employ hydraulically powered cylinders to move the wedge into a log or to move the log into the wedge. However, most heavy-duty hydraulic wood splitters are very bulky and are difficult to move from location to location.

It would be desirable to have an improved hydraulic wood splitter having heavy duty features that is lightweight and portable and that could be manually lifted and placed into the bed of a pickup truck for transport or manually moved from location to location.

Several references were produced from a preliminary patentability search in Class 144, subclass 193. These references include: McCormack, U.S. Pat. No. 5,337,810, issued Aug. 16, 1994; Chapman, U.S. Pat. No. 5,373,877, issued Dec. 20, 1994; Mires et al., U.S. Pat. No. 5,284,193, issued Feb. 8, 1994; Hamel, U.S. Patent No. 4,351,377, issued Sep. 28, 1982; Duerr, U.S. Pat. No. 4,782,870, issued Nov. 8, 1988. Some of these references may be relevant to the present invention, however, none are considered to anticipate the claims set forth in the present application.

Accordingly, a principal object of the present invention is to provide a heavy-duty hydraulic wood splitter that is compact and portable.

Another object of the invention is to provide a wood splitter having at least one pair of hydraulic cylinders laterally disposed within the frame of the splitter for providing greater splitting power and stability.

These and other objects and advantages of the present invention will become apparent to those persons skilled in the art from a study of the drawings and from a review of the following detailed description of a preferred embodiment of the invention.

BRIEF SUMMARY OF THE INVENTION

The present invention provides a compact wood splitter having an elongated I-beam having a center rail with a horizontally disposed top surface and bottom surface thereon. Hydraulic cylinders are laterally disposed within the beam structure on each side of the center rail. An elongated frame includes a pair of laterally disposed angle beams with a first splitting wedge mounted at one end between the angle beams that may transverse the length of the center rail. A second splitting wedge is mounted on the I-beam opposite the first wedge. The combination of the I-beam like structure and frame structure permits an effective compact wood splitter that uses a dual hydraulic power means contained within the frame of the splitter. The dual power means provides strength and stability in splitting logs.

BRIEF DESCRIPTION OF THE DRAWINGS

The invention will be further described in connection with the accompanying drawings, in which.

DETAILED DESCRIPTION

The wood splitter of the present invention solves the problem of providing a heavy-duty log splitter that is compact.

Figure 1:
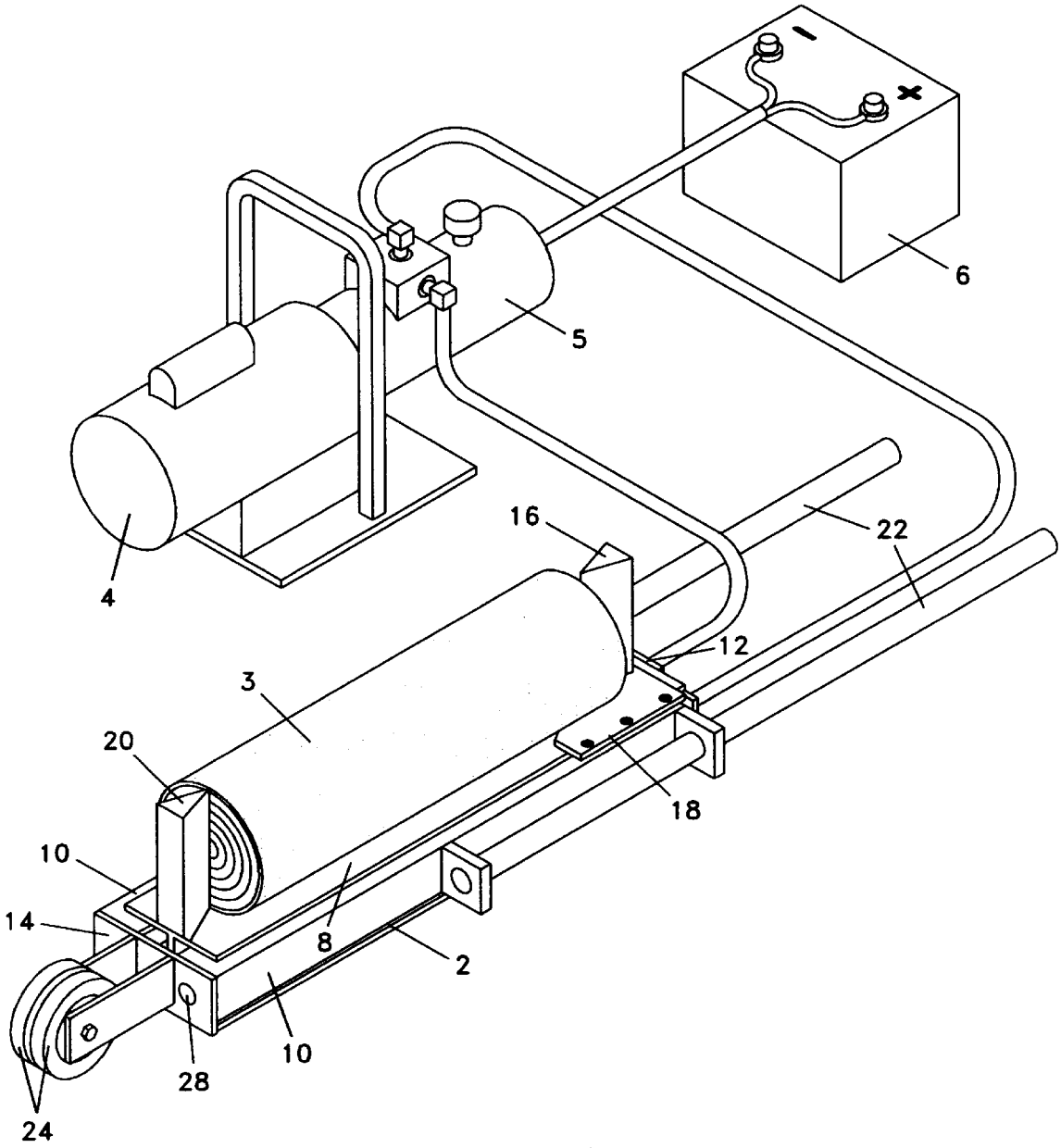
FIG. 1 is an orthographic view of the wood splitter of the present invention in the open position having a log thereon with external accessories shown.
Figure 2:
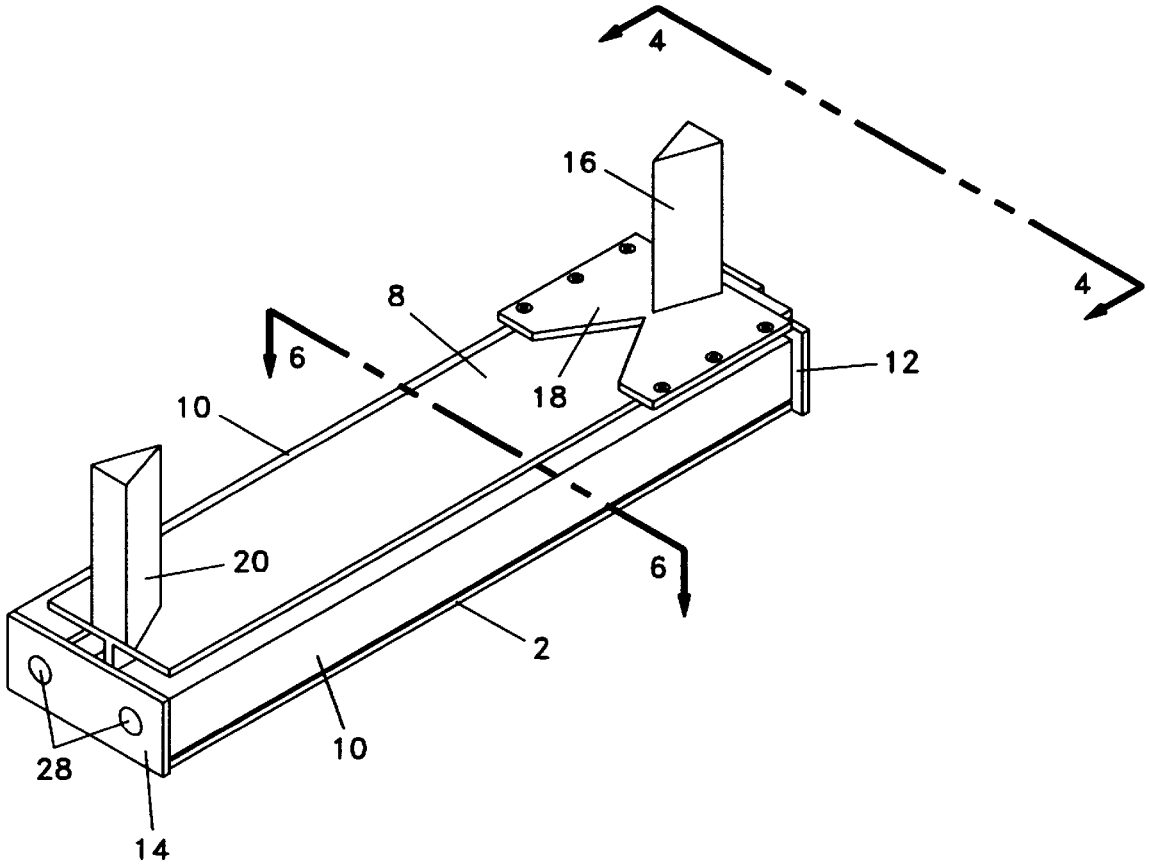
FIG. 2 is an orthographic view of the wood splitter of the present invention in the open position without external accessories.
Figure 3:
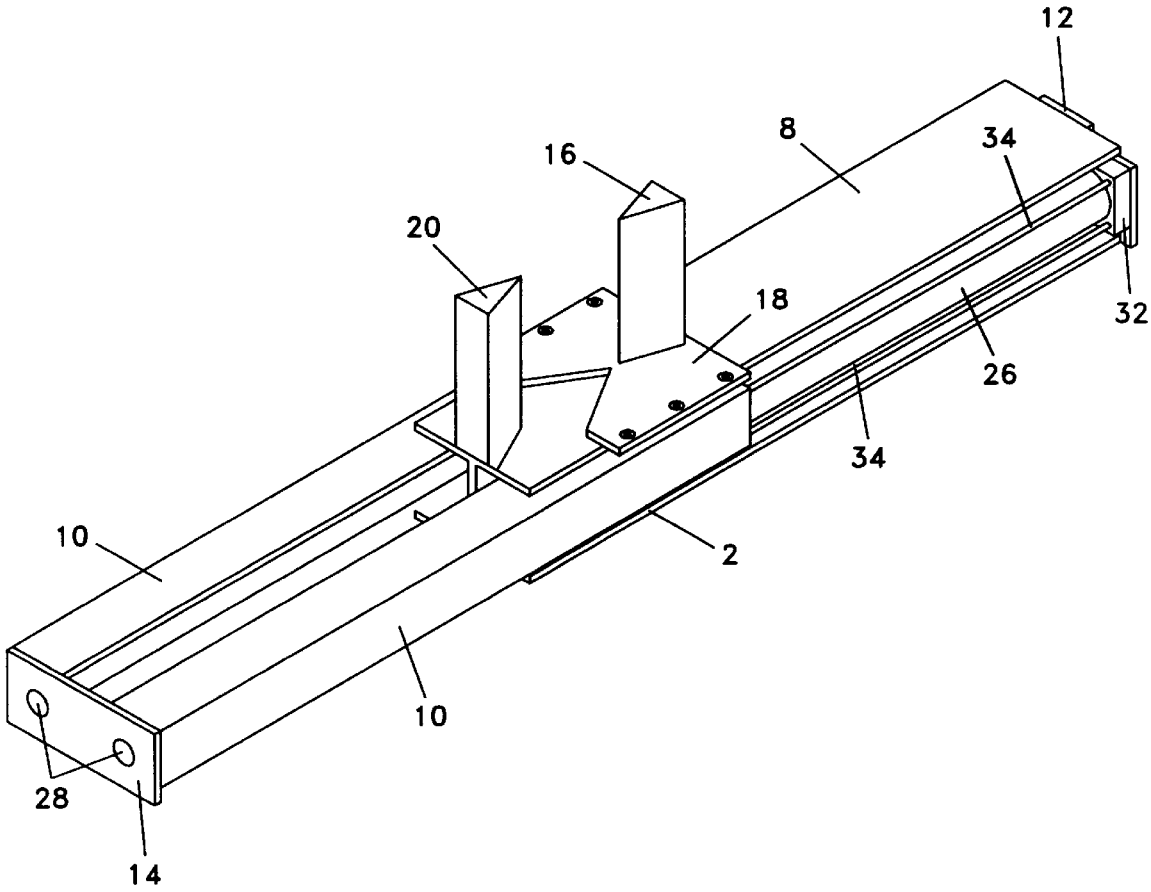
FIG. 3 is an orthographic view of the wood splitter of the present invention in the closed position.
Figure 4:
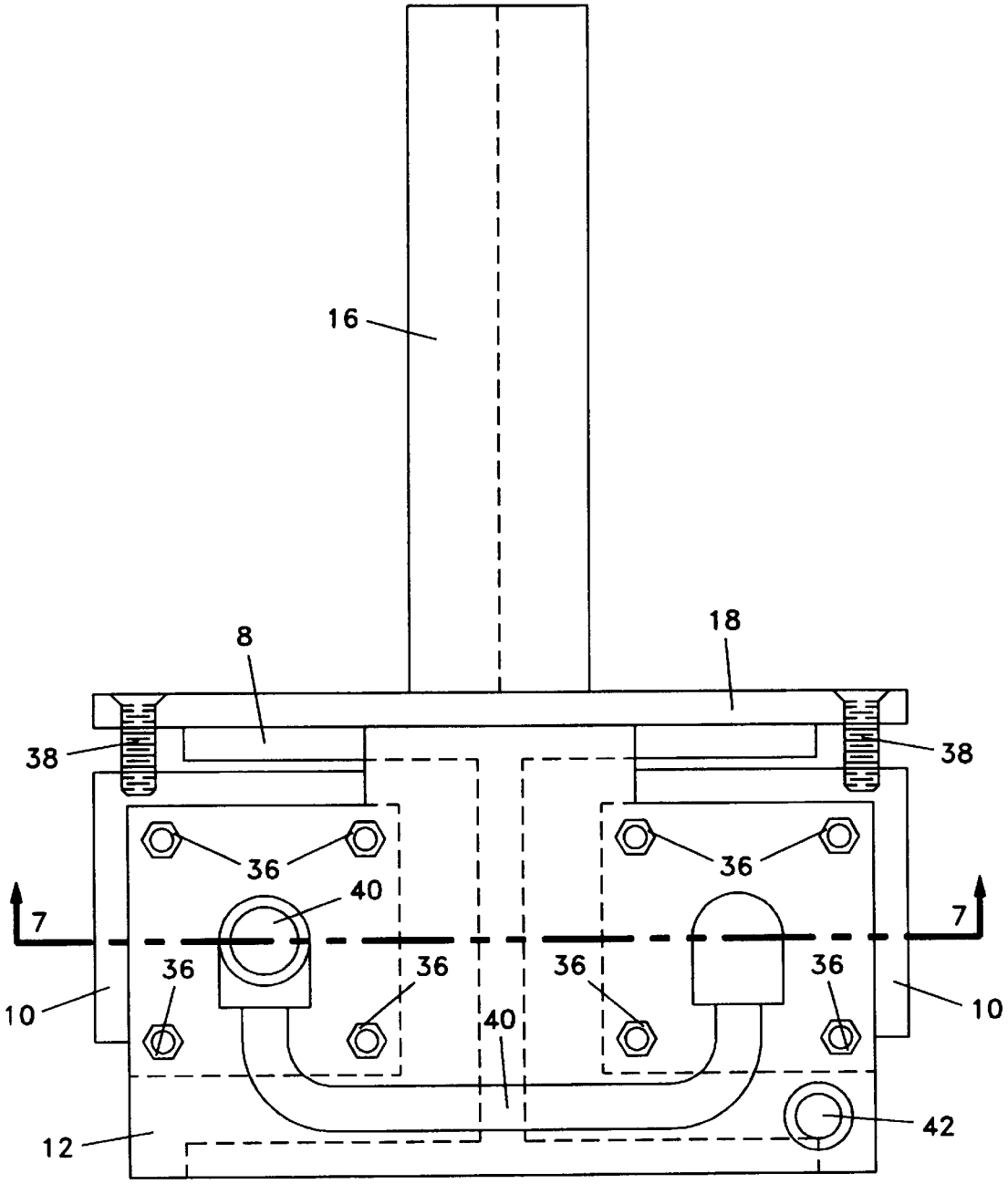
FIG. 4 is an end view of the wood splitter of FIG. 1 showing the invention and the hydraulic conduits attached thereto.
Figure 5:
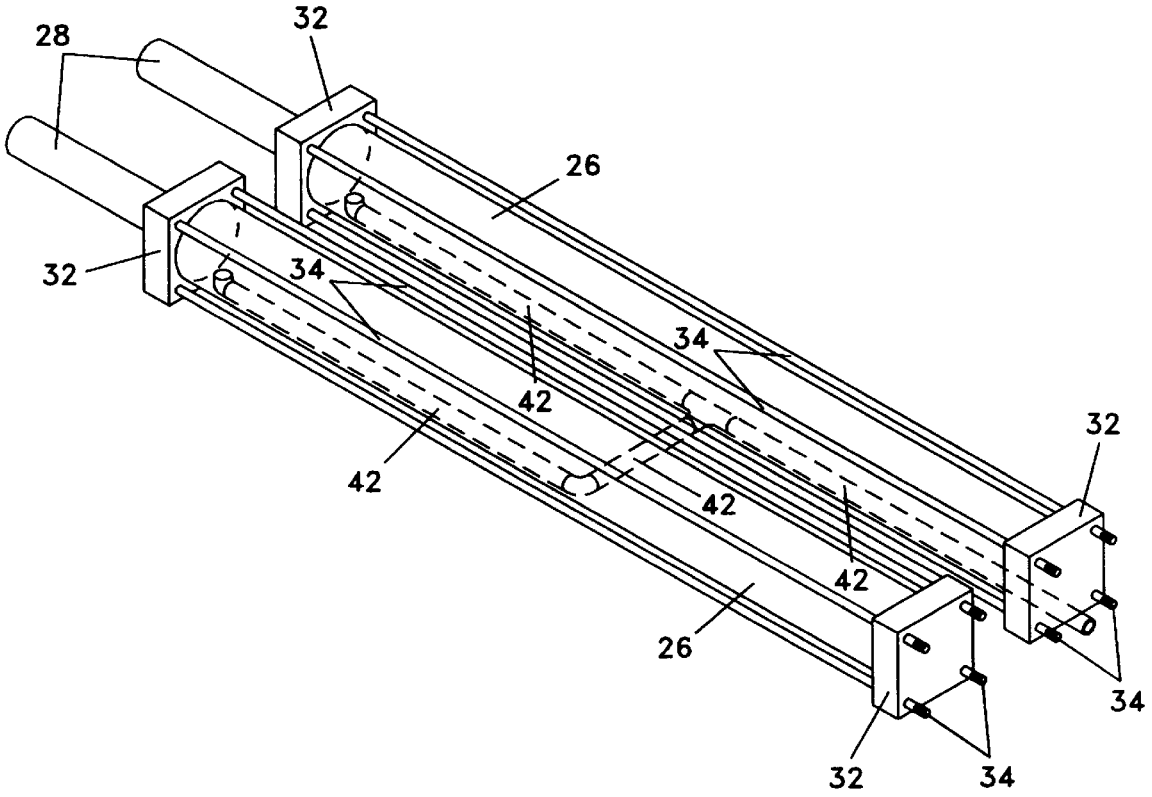
FIG. 5 is an orthographic view of the wood splitter of the present invention with the structural I-beam and frame portions removed for viewing of the cylinder arrangement therein.
Figure 6:
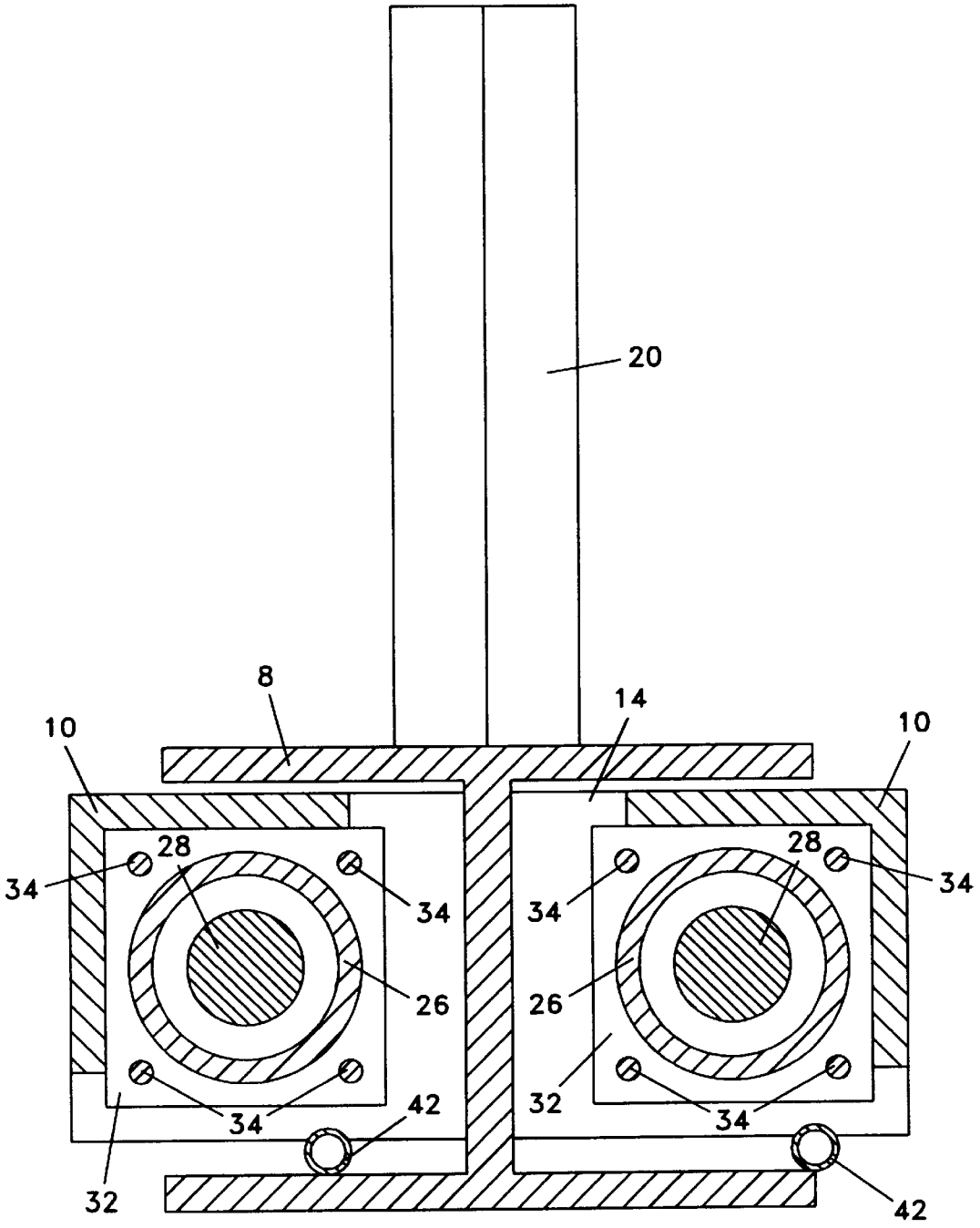
FIG. 6 is a sectional view taken along the vertical sectional line 6—6 of FIG. 2.
Figure 7:
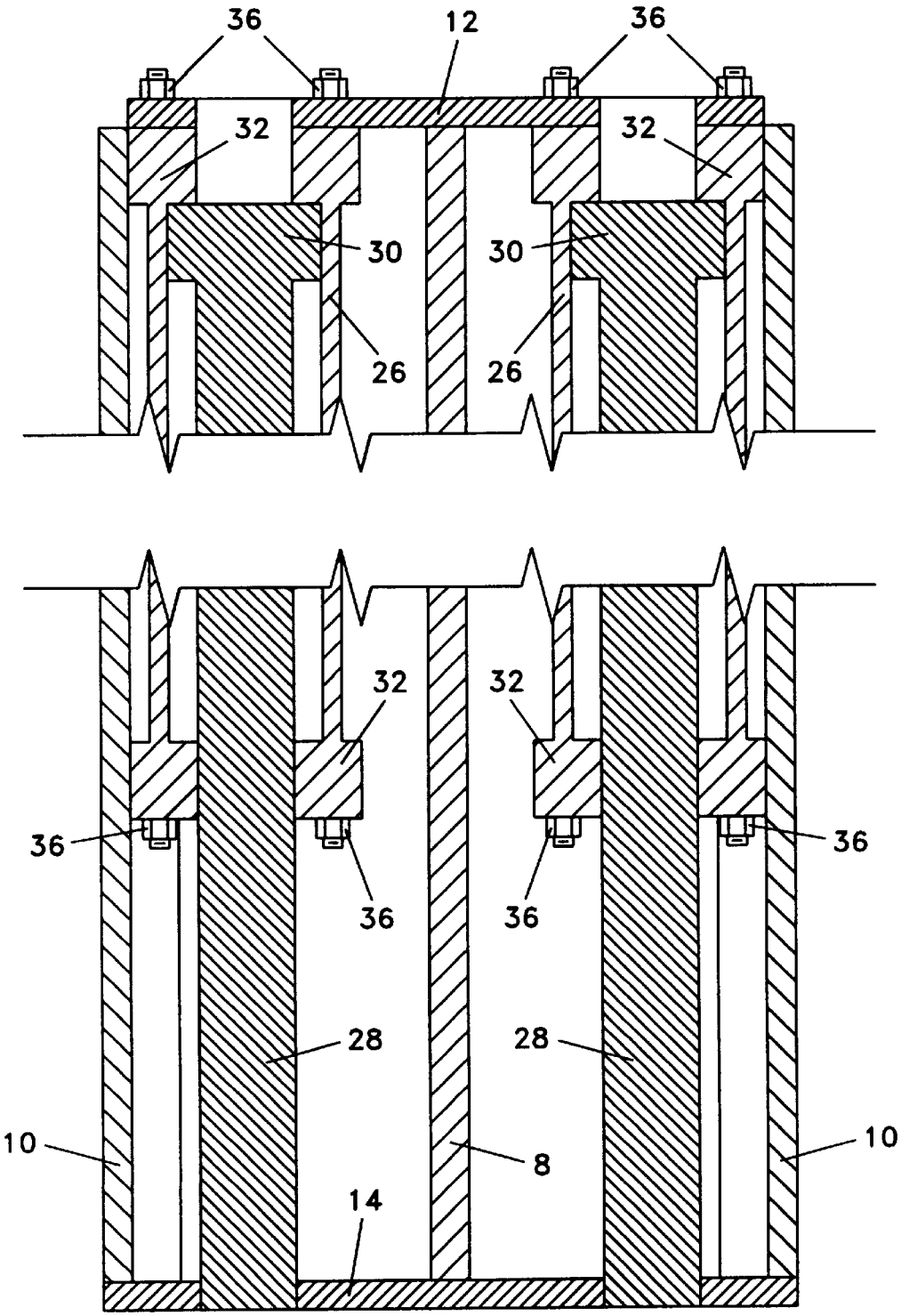
FIG. 7 is a sectional view taken along the horizontal sectional line 7—7 of FIG. 4.

Referring to the drawings, a preferred embodiment of the present splitter is shown in FIGS. 1–7. In FIG. 1 the wood splitter 2 used for splitting a log 3 is shown with an external source of high-pressure hydraulic fluid consisting of a pump 4, a motor 5, and a battery 6. The splitter 2 includes a central elongated beam 8 having a center rail with a horizontally disposed top surface and bottom surface thereon that may form an I-beam like structure as depicted in the embodiment of the drawings. The center rail and horizontally disposed surfaces of the beam 8 define channels on each side of the center rail. The bottom surface acts as the support for the unit when placed flat on a surface for splitting logs 3. A first push member 12 is attached at one end of the I-beam 8.

An elongated frame supported by the bottom surface of the I-beam 8 is comprised of a pair of laterally opposed angle beams 10. The frame is movable along the longitudinal axis of the I-beam 8 its entire length. The angle beams 10 are welded to a second push member 14 at one end and bolted by bolts 38 to a mounting plate 18 at the other end of the angle beams 10. The combination of the I-beam and the frame comprised of angle beams provide an especially strong structure that helps achieve the advantages of the present invention.

A splitting means is provided in which a first splitting wedge 16 is mounted to the mounting plate 18 that is welded to the angle beams 10. The mounting plate 18 is positioned above the I-beam 8 such that the mounting plate may transverse the upper surface of the I-beam. A second splitting wedge 20 is mounted to one end of the I-beam 8 opposite the first wedge 16. Therefore, as the mounting plate 18 transverses the I-beam 8 in a straight line motion along the I-beam's axis, the first wedge 16 moves toward the second wedge 20 to compress the log 3 that is placed between the two wedges. The log rests on the top surface of the I-beam 8.

A power means for making the splitting means operable is provided in which hydraulic cylinders 26 are provided and are laterally disposed on each side on the center rail within the channels defined by the I-beam 8. Each cylinder 26 includes a ram 28 that acts to move inward and outward from the cylinders when engaged by high-pressure hydraulic fluid. Accordingly, the motion of the rams 28 will be translated into reciprocatory motion of the wedges 16 and 20 with respect to each other. The rams 28 move the first wedge 16 into the closed position shown in FIG. 3 by bearing against the second push member 14 as the rams move outward from the cylinders 26. The cylinders 26 include a standard compression piston 30 that removes the hydraulic fluid from the cylinders. Air is dispersed from the hydraulic cylinders through the valve 40. Four support rods 34 are laterally disposed about the perimeter of each cylinder and are attached by nuts 36 to cylinder mounts 26 that are attached at each end of the I-beam 4. The support rods 34 provide structural support for the cylinders and hold the cylinders in place on the I-beam. Location of the cylinders within the I-beam frame structure helps make the splitter design more compact and helps decrease the splitter's required structure weight.

The hydraulic fluid for the cylinders is provided through conduits 42 by a source of high pressure fluid 4. A hydraulic pump providing high-pressure fluid at about 2500 psi would be sufficient and could be coupled with a small electric motor as a power supply 5. The present invention can utilize motors that can advantageously be powered by the choice of a 12-volt automobile type battery 6 or a 110-volt power outlet.

The use of dual cylinders, or multiple parallel cylinders, provides several advantages for the present invention. The dual cylinders provide compression strength for splitting logs, and the dual cylinders provide stability in splitting logs. For instance, the present invention can utilize a more efficient system of two wedges for splitting logs because the dual cylinder system keeps logs from rolling off when compressed. This dual wedge system opens logs faster and is especially advantageous when there is a knot at one end of a log that is more difficult to split. Alternatively, the splitter could be provided with a flat plate to replace one of the wedges for a log to abut against, but this would be less efficient for splitting logs.

A wheel means 24 and retractable handles 22 could be provided as additional features of the present log splitter. Thereby, the compact and portable log splitter of the present invention could be moved by extending its handles and rolling the splitter wheelbarrow style to its desired location. Alternatively, the handles could be replaced with other variations of means for moving the splitter, including a cross bar for a 3-point tractor hitch.

We claim:

1. A wood splitter comprising:

an elongated beam including a center rail, a horizontally disposed top surface and a horizontally disposed bottom surface defining a pair of channels;

a first push member attached at an end of said beam;

an elongated frame supported by said bottom surface and movable along the longitudinal axis of said beam through a range of travel less than the length of said beam;

a second push member attached at an end of the frame opposite the first push member;

a splitting means having a first splitting wedge affixed to said top surface and a second splitting wedge affixed to said frame relative to the first splitting wedge for splitting a log supported by said top surface;

at least one power means secured between the first push member and the second push member within each of said channels and operable to apply force to said frame along a line passing longitudinally through said splitting means.

2. The wood splitter as recited in claim 1 wherein the splitting means includes:

the first splitting wedge affixed to the top surface of the beam at the end opposite the first push member and having an edge for engaging a log at a first log end;

a mounting plate affixed to the frame at the end opposite the second push member;

a second splitting wedge affixed to the mounting plate and having and edge for engaging a log at a second log end opposite the first log end.

3. The wood splitter as recited in claim 1 wherein the frame is comprised of a pair of laterally opposed angle beams.

4. The wood splitter as recited in claim 1 wherein each of the power means includes a hydraulic cylinder affixed to the first push member and a fluid driven ram that extrudes from within said cylinder and abuts the second push member, whereby said ram applies force to said frame along a line passing longitudinally through said splitting means.

5. The wood splitter as recited in claim 4 wherein the power means further comprises a twelve volt battery providing electric power to a 12 volt powered electric motor that is coupled to a hydraulic pump providing a high-pressure fluid to each hydraulic cylinder.

6. The wood splitter as recited in claim 4 wherein four support rods are laterally disposed about the perimeter of each hydraulic cylinder and said cylinders and support rods are attached to cylinder mounts affixed to the ends of the beam.

7. The wood splitter as recited in claim 1 wherein retractable handles are attached to the frame.

8. The wood splitter as recited in claim 7 including wheel means for ground contact to roll said splitter when the handles are lifted upward.

* * * * *